United States Patent [19]

Fowler

[11] 4,384,424

[45] May 24, 1983

[54] HOLDER FOR CONICAL BULLETS

[76] Inventor: David L. Fowler, 1428 Sarkesian Dr., Petaluma, Calif. 94952

[21] Appl. No.: 266,704

[22] Filed: May 26, 1981

[51] Int. Cl.[3] ..... F41C 27/00
[52] U.S. Cl. ..... 42/90
[58] Field of Search ..... 42/90

[56] References Cited

U.S. PATENT DOCUMENTS 4,094,098 6/1978 Gourley ..... 42/90
4,254,572 3/1981 Nelson ..... 42/90

*Primary Examiner*—Charles T. Jordan
*Attorney, Agent, or Firm*—Andrew A. Steiner

[57] ABSTRACT

A device for holding and lubricating conical bullets for muzzle loading guns, is disclosed. The device comprises a plastic block, having a plurarity of vertical chambers for holding the bullets and two longitudinal channels for lubricating the bullets.

3 Claims, 5 Drawing Figures

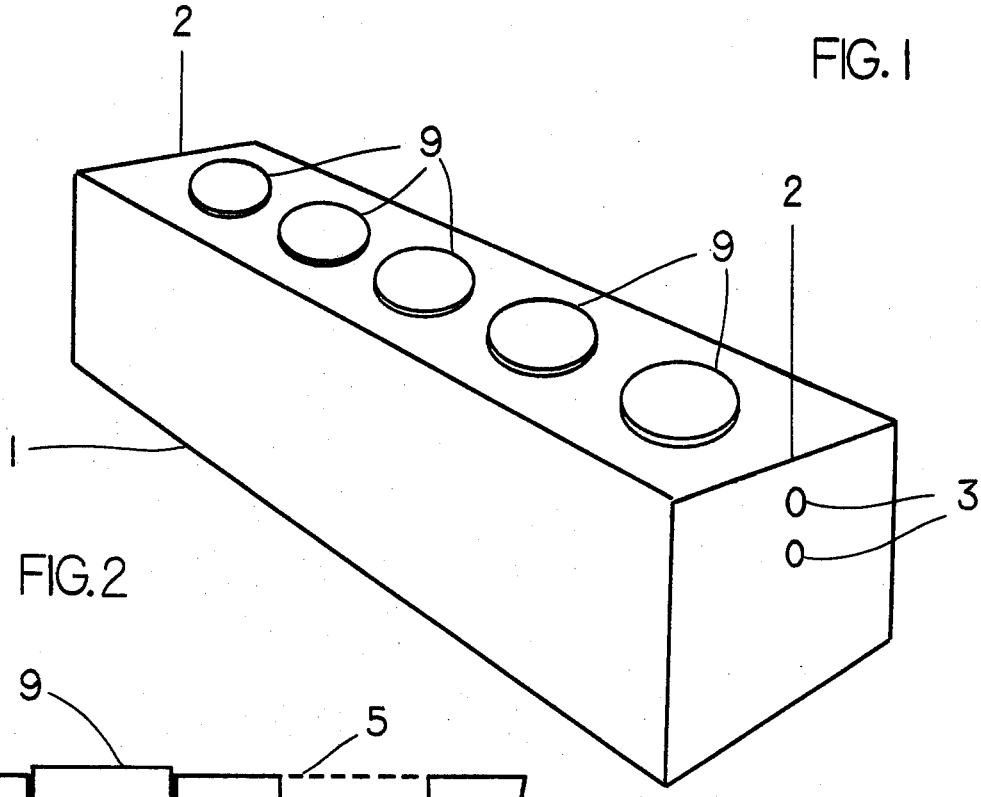
FIG. 1
FIG. 2
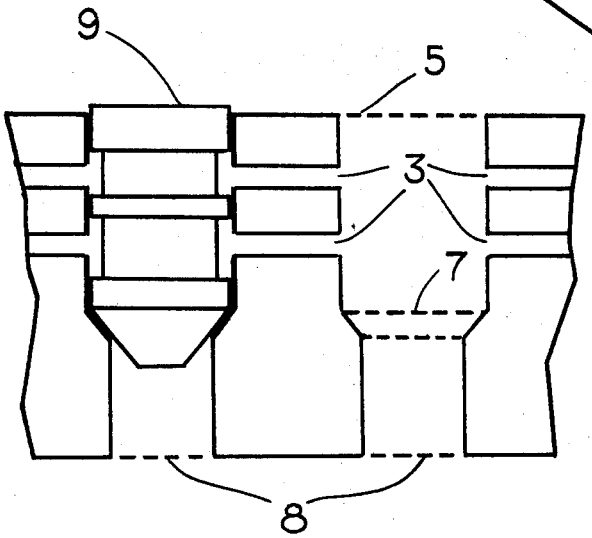
FIG. 3
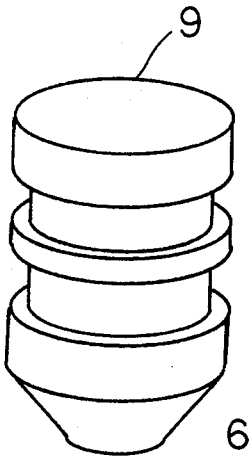
FIG. 4
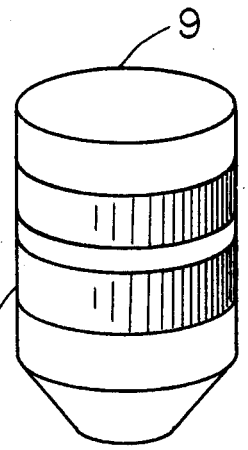
FIG. 5
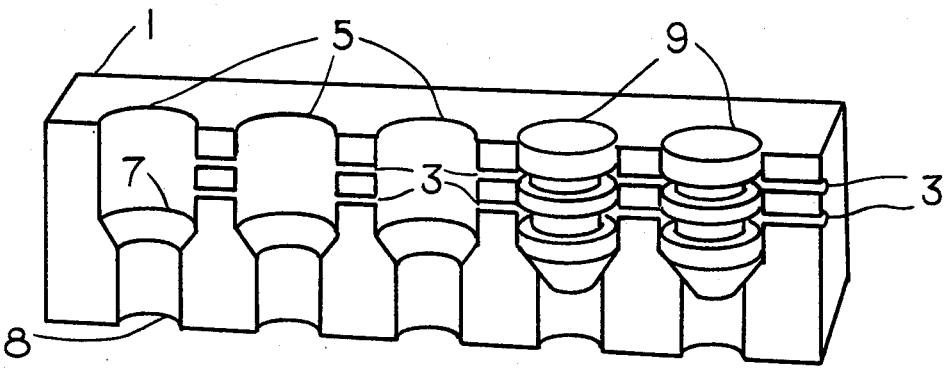

HOLDER FOR CONICAL BULLETS

BACKGROUND OF THE INVENTION

The present invention relates to a holder for conical bullets in general and in particular, to a device which provides means of lubricating the bullets.

U.S. Pat. No. 2,995,280 to Thierry, discloses a device, holding shells; however, the present invention, in addition to holding the bullets, provides means for their lubrication and, as it will appear from the detailed description, facilitates the loading of the muzzle loading guns.

DESCRIPTION OF THE DRAWINGS

FIG. 1 is a perspective view of the device with the bullets in the chambers.

FIG. 2 is a portion of a cross section of the device.

FIG. 3 is a perspective view of the conical bullet.

FIG. 4 is a perspective view of the lubricated bullet.

FIG. 5 is a cross section of FIG. 1, along the lines 2—2.

DETAILED DESCRIPTION

Referring now to the drawings, FIG. 1 shows the device with the bullets 9 in the chamber 5 and slightly extending above the surface of the holder in order to enable the user to line up the bullet by feel with the barrel of the gun. FIG. 5 shows the detailed construction of the holder.

The lower portion of the chamber 5 has a diameter to accommodate tightly the bullet. The upper portion of the chamber 7 is narrower than the bullet 9. The position of the narrow portion 7 of the chamber determines the extent the bullet 9 is insertable into the chamber and the said narrow portion is located in a position that the bullet 9 will extend slightly beyond the block's surface.

Longitudinally across the block there are two channels 3. The channels are located to correspond with the grooves 6 of the bullet. At one end of the block the channels are open, allowing the introduction of the grease for lubricating. At the closed end the two channels are connected by a groove in the wall of the chamber, not shown in the drawing. The chambers 5 are open at both ends. In use, the bullets 9 are forced into the chambers 5, and lubricated by a grease gun through the channels 3. In loading, the bullet 9 is lined up with the barrel by feel and forced into the barrel.

I claim:

1. A bullet holder and lubricator for grooved conical bullets comprising: an elongate plastic block, having a plurality of cylindrical chambers, the diameter of said chambers correspond to the diameter of the bullets, two channels across the length of the block located at the height of the bullet's groove and each having an opening entrance.

2. A device, according to claim 1, where the upper portion of the chambers has a smaller diameter than the diameter of the bullet, defining the bullet's position in the chamber.

3. A device, according to claim 2 where the base of the bullets extend above the block's surface.

* * * * *